United States Patent [19]

Clark et al.

[11] 4,246,510

[45] Jan. 20, 1981

[54] RETINA FOR PYROELECTRIC VIDICON

[75] Inventors: Wellman L. Clark, Springfield; John T. Cox, Alexandria; Gerald Klauber, Fredericksburg; Ferdinand C. Petito; John B. Ramsey, Jr., both of Alexandria; John E. Waylonis, Fairfax Station, all of Va.

[73] Assignee: The United States of America as represented by the Secretary of the Army, Washington, D.C.

[21] Appl. No.: 647,271

[22] Filed: Jan. 7, 1976

[51] Int. Cl.[2] ..... H01J 29/45; H01J 31/49

[52] U.S. Cl. ..... 313/388; 313/101

[58] Field of Search ..... 313/388, 101, 386; 250/333

[56] References Cited

U.S. PATENT DOCUMENTS

| | | | |
|---|---|---|---|
| 3,082,340 | 3/1963 | Schneeberger | 313/388 |
| 3,350,595 | 10/1967 | Kramer | 313/386 |
| 3,725,711 | 4/1973 | Sadler | 313/288 X |
| 3,928,768 | 12/1975 | Crowell | 250/333 |
| 3,930,157 | 12/1975 | Watton | 313/388 |
| 4,019,084 | 4/1977 | Conklin et al. | 313/388 |

*Primary Examiner*—Robert Segal

*Attorney, Agent, or Firm*—Nathan Edelberg; Milton W. Lee; John E. Holford

[57] ABSTRACT

A retina is provided for a pyroelectric vidicon which is rugged, long lived, and has increased resistance to contamination by normal environments encountered during testing and subsequent installation in the vidicon tube.

3 Claims, 3 Drawing Figures

RETINA FOR PYROELECTRIC VIDICON

The invention described herein may be manufactured, used, and licensed by or for the Government for governmental purposes without the payment of any royalty thereon.

BACKGROUND OF INVENTION

Thermal imaging systems have achieved an important status in military and commercial operations. These systems do not require any supplemental radiation other than that radiated by the object or scene under investigation. The radiation involved is in the infrared region. Current real-time systems rely primarily on semiconductor diodes as the detecting media. These in turn depend on certain bandgap energies which limit their efficiency to rather narrow bands. Most systems employ a linear array of diodes across which the image is swept by a scanning mirror. Additionally, the diodes work well only at cryogenic temperatures, and such systems are noisy, bulky and inefficient.

Retinas consisting of bolometric devices have been used successfully with electron scanning, but these lack resolution in the infrared region. These retinas also require cryogenic cooling, which is made more difficult by the hard vacuum requirements of the system.

A new retina has been introduced in fairly recent times in a device known as the pyroelectric vidicon. This retina utilizes changes in the electric polarization induced in a pyroelectric material when exposed to radiation. Since the retina is only responsive to temperature changes, i.e. thermal images, in the scene projected on it, it makes an excellent moving target indicator. Fixed targets or scenes can be viewed in a variety of operational modes such as by panning the camera, or otherwise modulating the scene intensity. Since the retina works well at room temperature, power requirements are modest. The chief difficulty with these devices has been that the retinas are subject to erosion by the electron beam in the vidicon and are extremely sensitive to moisture. As a result vidicons made from them, though initially testing out satisfactorily, have been usually very short lived, i.e. at most a few hundred hours.

BRIEF DESCRIPTION OF INVENTION

An object of the present invention is, therefore, to provide an improved retina for use in pyroelectric vidicons and other devices requiring infrared detectors.

Still a further object of the invention is to provide a method of making retinas from pyroelectric materials which stabilizes their best qualities through subsequent processing and use.

BRIEF DESCRIPTION OF DRAWINGS

The invention is best understood with reference to the accompanying device wherein.

DESCRIPTION OF INVENTION

Figure 1:
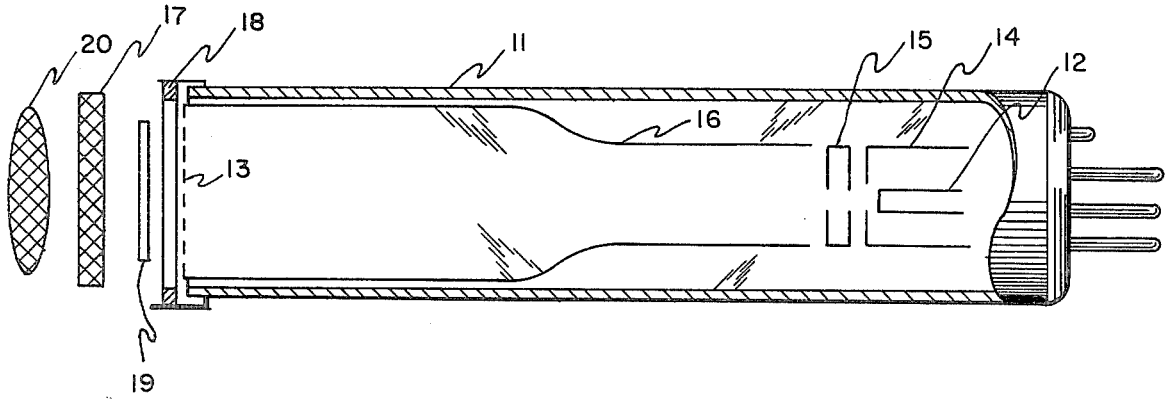
FIG. 1 shows an improved pyroelectric vidicon.

Referring more specifically to FIG. 1 there is shown a pyroelectric vidicon. Like normal vidicons there is provided within a glass envelope 11 a cathode 12, an anode 13, and beam forming electrodes 14, 15 and 16. The tube may also contain focussing and deflection electrodes (not shown) or these functions can be supplied by external magnetic coils (also not shown). The faceplate 17 is formed of germanium or other material having a low absorption coefficient for infrared radiation (IR). This may be joined to the glass envelope by means of a metallic signal ring 18 which includes indium seal 18A. The pyroelectric retina 19 is mounted on the faceplate before the latter is joined to the glass envelope. The usual hard vacuum is maintained within the tube to permit electron transport and reduce ion bombardment of the cathode and retina. Suitable IR optics, e.g. germanium lenses 20 are mounted ahead of the faceplate to focus the IR image on the retina.

Figure 2:
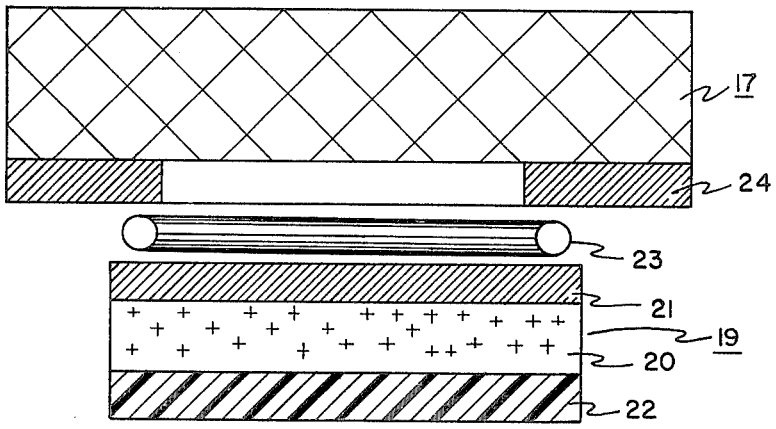
FIG. 2 shows a more detailed view of the faceplate and retina assembly from FIG. 1.

FIG. 2 shows the structure of the faceplate and retina in greater detail. The retina 19 consists of a wafer 20 of pyroelectric material 10–200 microns thick coated on one side with a thin metallic electrode 21 of nichrome or other metal having a low reflectance in the infrared region. The opposite side is coated with a thin layer 22 of dielectric material which like the nichrome is more stable and less permeable to moisture than the pyroelectric material. The nichrome or any material substituted therefor should be electrically conductive and have a similar thermal conductivity. The dielectric material should have a secondary emission coefficient greater than one and a sheet resistance greater than $10^{12}$ ohms per square. The dielectric layer serves to protect the pyroelectric material from erosion by the electron beam and residual gas ions when it is used in a vidicon tube. Suitable materials for the dielectric layer (in thicknesses of approximately 50–2000 Å are $SiO_2$, $SiO_x$, $BaF_2$, MgO, $MgF_2$, KCl, $BaO_2$, spinel and Ge ($SiO_x$ being an intermediate mixture of $SiO_2$ and SiO). Many pyroelectric materials can be used successfully in the present invention including, but not limited to:

Triglycine Sulphate $(H_2NCH_2OOH)_3H_2SO_4$;
Triglycine Tetrafluoroberyllate $(H_2NCH_2COOH)2HBF_2$;
Deuterated Triglycine Tetrafluoroberyllate $(H_2NCH_2COOH)2DBF_4$;
Lithium Tantallate $LiTaO_3$;
Lithium Niobate $LiNbO_3$; and
Lead Lanthanum Zirconate $Pb_xLa_{1-x}(ZrO_3)_2$.

The faceplate 17 has a nichrome border 24 which is electrically connected to the signal ring via the indium seal. The wafer 20 is attached to the faceplate 17 by cementing the nichrome elements 21 and 24 together with a conductive epoxy adhesive 23.

Figure 3:
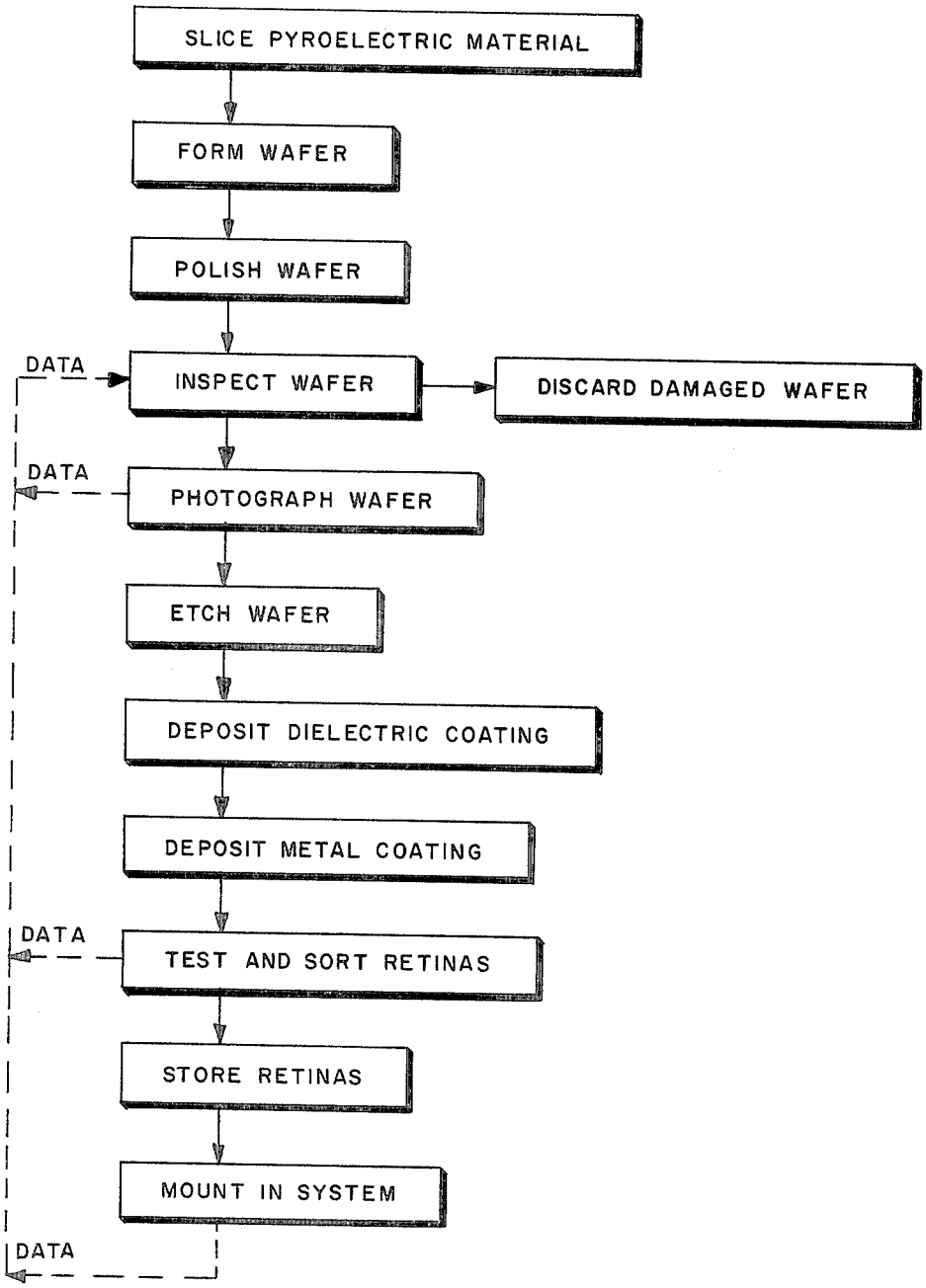
FIG. 3 is a flow diagram of the process for making the retina in FIGS. 1 and 2.

FIG. 3 shows a flow diagram of the method for forming the retina; since this affects performance, i.e. sensitivity and operating life, it is, therefore, a key facet of the present invention. Once a bulk sample of the pyroelectric material is obtained the following steps are followed:

1. The material is sliced into thin plates;
2. The plates are cut into smaller wafers having the desired lateral dimensions of the finished retina;
3. The wafers are then polished with a submicron grit finishing with a polishing etch to a thickness of 10–500 microns; at this point the wafers are very soft and fragile, easily damaged by temperature strains and extremely sensitive to water vapor or other impurities present in the atmosphere;
4. The wafers are thus quickly inspected for surface uniformity and quality using a suitable optical magnifying instrument with minimum handling under normal clean room conditions and unsuitable wafers discarded;

5. If the wafer surface shows little or no damage, it is photographed, the photographs serving as feedback data to establish the maximum tolerances of surface irregularities and impurities to meet various performance and/or lifetime requirements in the finished retina;

6. The photographed wafers are immediately transferred to a vacuum chamber with an ion etching system (e.g. Veeco Micro Etch) where the pressure is reduced to an appropriate value to the etch rate desired; and the surface of the wafer is etched by inert ion scrubbing to a depth of 0.1 to 5 microns;

7. The dielectric layer is then deposited preferably in the same vacuum chamber until a film thickness between 50–2000 Å is obtained, the layer preferably being deposited in two or more increments each followed by a gas flushing of the retina surface to remove or displace contaminants between increments;

8. The low reflectance metallic film is then deposited on the opposite side of the wafer by the same procedure as step #8 (steps #8 and #9 are interchangeable, but step #9 is peferably performed on the best surface of the wafer when there is a detectable difference in the two surfaces), the wafer at this point is now substantial enough to endure the environmental conditions involved in vidicon manufacturing procedures;

9. The wafer is next inserted in a special demountable vidicon structure where it is tested under operating conditions so that the wafers can be sorted for use or final disposal;

10. Being stable, the wafers may be stored indefinitely in a dry atmosphere;

11. When required, the wafer is removed from storage and mounted in a vidicon tube or other optical device.

The wafers manufactured by this method have a minimum resolvable temperature difference (MRTD) of 0.3° C., whereas previous wafers had a MRTD of 1°–3° C. The large area variation of response over the entire face of the wafer has been reduced from approximately 30% in previous vidicons to less than 5%. Small area variations (particularly dead spots) have also been significantly reduced improving both resolution and total sensitivity. Most significant is the increase in operating life from a few hundred to over two thousand hours.

We claim:

1. In an optical system, wherein a wafer of pyroelectric material chosen from the group comprising Triglycine Sulphate, Triglycine Tetrafluoroberyllate, Deuterated Triglycine Tetrafluoroberyllate, Lithium Tantallate, Lithium Niobate, and Lead Lanthanum Ziroconate is coated on one broad side with a thin layer of conductive material and an electronic means coupled to said thin layer is provided to scan the remaining broad side of said wafer with an electron beam whereby a thermal image induced on said one side is detected; the improvement comprising:

a single layer only of dielectric material entirely covering said remaining side of said wafer, said layer having a secondary emission coefficient greater than one and having a sheet resistance greater than $10^{12}$ ohm/square, and said dielectric layer being formed of a compound chosen from the group consisting of $SiO_2$, $BaF_2$, MgO, MgF, KCl, $BaO_2$, spinel and Ge.

2. In an optical system, wherein a wafer of pyroelectric material chosen from the group comprising Triglycine Sulphate, Triglycine Tetrafluoroberyllate, Deuterated Triglycine Tetrafluoroberyllate, Lithium Tantallate, Lithium Niobate, and Lead Lanthanum Ziroconate is coated on one broad side with a thin layer of conductive material and an electronic means coupled to said thin layer is provided to scan the remaining broad side of said wafer with an electron beam whereby a thermal image induced on said one side is detected; the improvement comprising:

a single layer consisting only of silicon dioxide entirely covering said remaining broad side.

3. In an optical system, wherein a wafer of pyroelectric material chosen from the gorup comprising Triglycine Sulphate, Triglycine Tetrafluoroberyllate, Deuterated Triglycine Tetrafluoroberyllate, Lithium Tantallate, Lithium Niobate, and Lead Lanthanum Ziroconate is coated on one broad side with a thin layer of conductive material and an electronic means coupled to said thin layer is provided to scan the remaining broad side of said wafer with an electron beam whereby a thermal image induced on said is detected; the improvement comprising:

a single layer only of dielectric material entirely covering said remaining broad side of said wafer, said layer having a secondary emission coefficient greater than one and having a sheet resistance greater than $10^{12}$ ohm/square, and said dielectric layer being formed of a compound chosen from the group consisting of $BaF_2$, MgO, MgF, KCl, $BaO_2$, spinel and Ge.

* * * * *